United States Patent [19]

Cheng

[11] Patent Number: 4,712,267

[45] Date of Patent: Dec. 15, 1987

[54] CONVERTIBLE TOOTHBRUSH

[76] Inventor: Peter S. C. Cheng, 5 Ross Street, Toronto, Ontario, Canada, M5T 1Z8

[21] Appl. No.: 937,873

[22] Filed: Dec. 4, 1986

[51] Int. Cl.[4] ..... A46B 9/04

[52] U.S. Cl. ..... 15/172; 15/167 R; 15/201; 15/143 R

[58] Field of Search ..... 15/172, 167 R, 201, 15/143 R, 144 R, 144 B

[56] References Cited

U.S. PATENT DOCUMENTS 1,199,268 9/1916 Haller ..... 15/172

1,688,581 10/1928 Glassman ..... 15/172 X 2,240,076 4/1941 Kramer ..... 15/167 R X 2,254,365 9/1941 Griffith et al. ..... 15/172 X

*Primary Examiner*—Peter Feldman

*Attorney, Agent, or Firm*—Kirschstein, Kirschstein, Ottinger & Israel

[57] ABSTRACT

A flexible brush block is moved along a shape-retaining S-shaped handle whose curved end regions of opposite curvature are responsible for bending the flexible block and bristles that are supported thereon into either a generally concave or a convex configuration.

17 Claims, 18 Drawing Figures

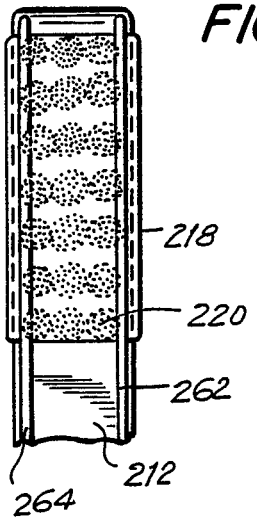
FIG. 12
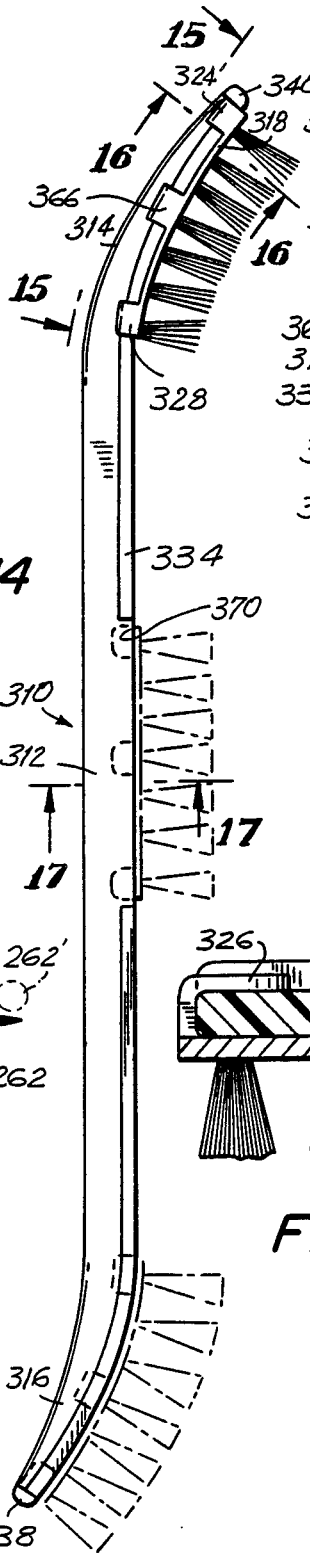
FIG. 14
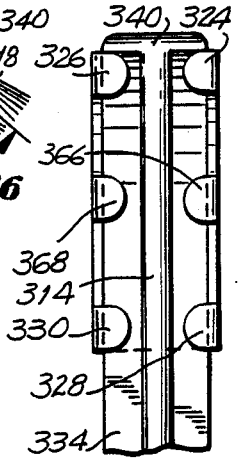
FIG. 15
FIG. 13
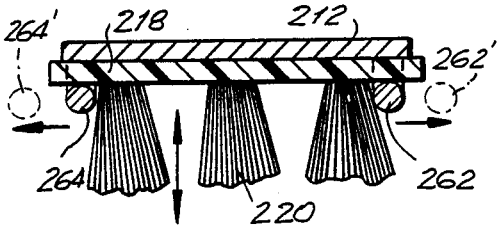
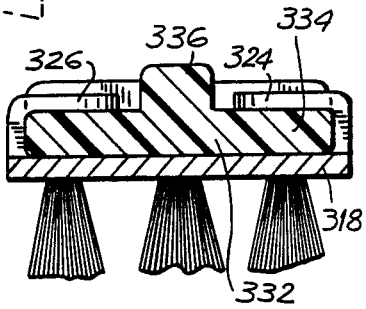
FIG. 16
FIG. 17
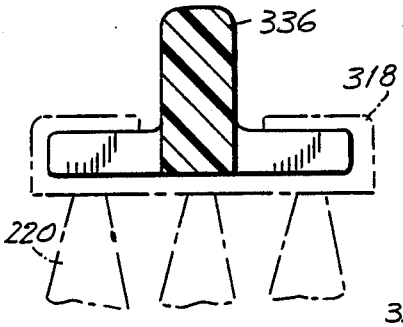

CONVERTIBLE TOOTHBRUSH

BACKGROUND OF THE INVENTION

1. Field of the Invention

This invention generally relates to toothbrushes and, more particularly, to convertible toothbrushes whose bristles can be changed to a convex, concave or straight bristle configuration at the will of a user.

2. Description of the Related Art

It is known that, for proper cleaning of the exterior surfaces of teeth, toothbrush bristles should advantageously be shaped in a concave configuration. On the other hand, inner surfaces of the teeth are best cleaned when the bristles are shaped in a convex configuration. Conventional toothbrushes having bristles of a fixed contour have been made with either a convex or a concave bristle configuration, but not both. Hence, such single-configuration toothbrushes cannot properly clean both the interior and exterior tooth surfaces with the same degree of cleaning efficiency.

It has heretofore been proposed, for example, in U.S. Pat. No. 3,935,611, to provide a body brush having multiple bristle sections, one bristle section being convex while another bristle section is concave, but such large-sized body brushes are difficult to manipulate and, in any event, are not designed to readily fit inside a user's mouth. Convertible toothbrushes such as disclosed in U.S. Pat. No. 1,968,411, which are designed to readily fit in one's mouth, still are awkward to manipulate because at least one of the bristle sections must be moved relative to the other to obtain the desired bristle configuration.

Conventional toothbrushes, in which a single bristle section contour is changeable, have been proposed in U.S. Pat. Nos. 2,429,437; 2,864,111; 4,409,701 and 2,254,365. However, such convertible toothbrushes all require the use of at least one rotary or slidable actuator incorporated into the toothbrush, thereby necessitating a multi-partite, complex and costly product. The known convertible toothbrushes have proven to be generally unreliable and awkward in use.

SUMMARY OF THE INVENTION

1. Objects of the Invention

It is a general object of the present invention to overcome the above-mentioned drawbacks of the prior art of convertible toothbrushes.

Another object of this invention is to provide a reliable toothbrush which can be easily manipulated by a user to either a convex or concave configuration.

A further object of this invention is to provide a convertible toothbrush which can clean both interior and exterior tooth surfaces with the same degree of cleaning efficiency.

Yet another object of this invention is to reduce the complexity and cost associated with conventional rotary or slide actuator convertible toothbrushes.

Still another object of this invention is to provide a reliable, inexpensive and easy to manipulate convertible toothbrush which is durable in use and inexpensive to manufacture.

2. Features of the Invention

In keeping with these objects, and others which will become apparent hereinafter, one feature of this invention resides, briefly stated, in a convertible toothbrush which comprises a generally S-shaped handle and a flexible brush block for supporting bristles. The handle is made of a shape-retaining material which is more resistant to bending, as compared to the flexible block. The handle has curved end regions of opposite curvature.

In accordance with this invention, the flexible brush block is mounted on the handle for movement between one of the curved end regions in which the one curved end region bends the flexible block and the bristles supported thereon into a generally concave configuration, and another of the curved end regions in which the other curved end region bends the flexible block and the bristles supported thereon into a generally convex configuration. Thus, in contrast to prior art designs, no independent rotary or slide actuator element need be incorporated into the toothbrush. Instead, it is the oppositely curved end regions themselves which are responsible for bending the flexible block into the desired bristle configuration.

This invention also includes means for preventing the block from being moved past either curved end region and off the handle. In a preferred embodiment, a stationary abutment and a displaceable abutment are provided at opposite curved end regions of the handle. The displaceable abutment is displaceable between an abutting position in which the displaceable abutment is situated in the path of movement of the block, and a release position in which the displaceable abutment is situated remote from the path of movement of the block. Hence, the flexible block may be slid off or slid onto the handle in the release position. The stationary abutment is not so displaceable, and always extends in the path of movement of the block at its curved end regon.

In one preferred embodiment of this invention, the handle is provided with a slide track, and the block is provided with legs opposing each other and forming a slide channel along which the slide track is slidably engaged.

In another embodiment, the handle is provided with a channel-shaped slide track along which the block is slidably engaged.

In still another embodiment, a pair of guide wires are spaced from, and extend along, the handle to form a channel along which the block is slidably engaged.

To guide the block during its longitudinal movement lengthwise of the handle, a longitudinal guide extends along the handle, and is operative for guiding the block during its movement.

In practicing this invention, a user need only slide the block from one end of the handle to the other to change the bristle configuration to either the convex or concave configuration, as desired. Should the bristles on a brush block be worn, then the block with the worn bristles may be readily interchanged with another block having fresh bristles.

It is also contemplated that a single handle can be used for multiple users wherein each user has his or her own flexible brush block for mounting on the common handle.

Rather than forming the toothbrush handle of an S-shape whose opposite curved end regions have opposite curvatures, it is also within the spirit of this invention to form one of the end regions of the handle to have a straight contour. As before, the curved end region is operative to bend the flexible block and the bristles supported thereon into a correspondingly curved configuration, i.e. convex or concave, as desired. However, the straight end region of the handle enables the flexible block and the bristles supported thereon to assume a generally straight configuration. Hence, this modified toothbrush is convertible between a curved and a straight bristle configuration.

It is also desirable to prevent the block from moving away from any of its assigned regions on the toothbrush handle, i.e. the curved end region or the straight end region and, for that purpose, a resilient bead or a resiliently-yieldable stopper may engage the brush block, although it has been found that a snug frictional fit between the brush block and the handle is usually sufficient to prevent such movement.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 12 is a front plan view taken along line 12—12 of FIG. 11;

FIG. 13 is an enlarged sectional view taken along line 13—13 of FIG. 11;

FIG. 14 is a side view of a convertible toothbrush according to yet another embodiment of this invention;

FIG. 15 is a rear plan view taken along line 15—15 of FIG. 14;

FIG. 16 is an enlarged sectional view taken along line 16—16 of FIG. 14;

FIG. 17 is an enlarged sectional view taken along line 17—17 of FIG. 14; and

DETAILED DESCRIPTION OF THE PREFERRED EMBODIMENTS

Figure 1:
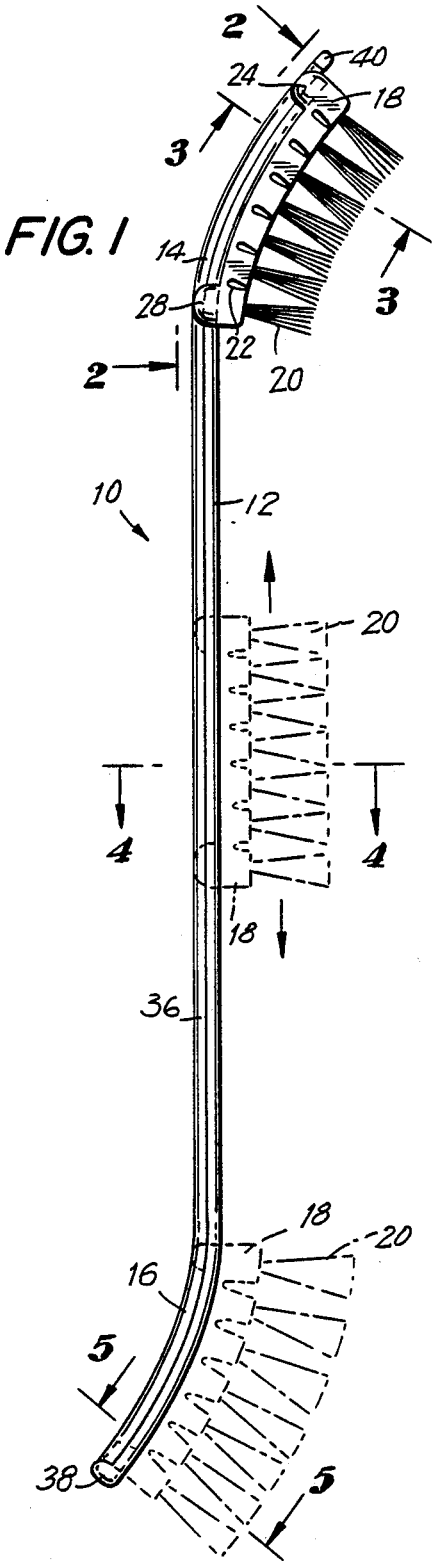
FIG. 1 is a side view of a convertible toothbrush according to one embodiment of this invention.

Referring now to the drawings and, turning initially to the first embodiment of FIGS. 1-7, reference numeral 10 generally identifies a toothbrush whose bristles are convertible between a concave and a convex configuration, as respectively shown in solid and dashed lines in FIG. 1. The toothbrush 10 includes a generally S-shaped elongated handle 12 constituted of shape-retaining material, and having curved end regions 14, 16 of opposite curvature. A flexible brush block 18 for supporting a plurality of tufts of bristles 20 is mounted on the handle 12 for longitudinal movement lengthwise of the handle between curved end regions 14, 16. Preferably, the inner ends of bristles 20 are embedded within block 18 and, although not strictly necessary, the bristles all have more or less the same length. The shape-retaining material of the handle 12 can be made of synthetic plastic or metal material, and may be generally characterized as being rigid, semi-rigid or stiff. The brush block 18 can likewise be made of synthetic plastic or metal material, it being necessary that the shape-retaining material of the handle 12 be more resistant to bending than the more flexible material of the block. To increase the flexibility or bendability of the block 18, the block may be provided with transverse grooves or slits 22, each slit extending transversely of the elongation of the handle 12, the slits 22 being spaced apart lengthwise of the handle.

Figure 2:
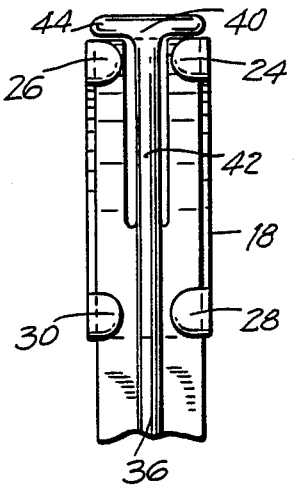
FIG. 2 is a partly broken-away rear plan view as seen along line 2—2 of FIG. 1.
Figure 3:
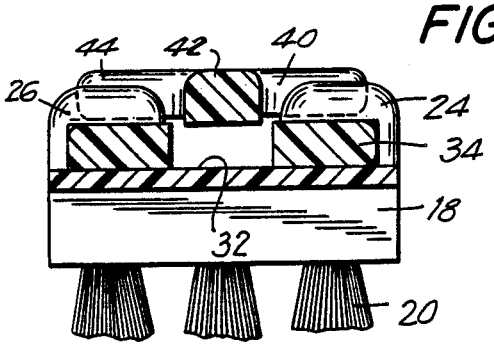
FIG. 3 is an enlarged sectional view taken along line 3—3 of FIG. 1.

As best shown in FIG. 2, block 18 has a first pair of generally L-shaped legs 24, 26, and a second pair of L-shaped legs 28, 30 spaced longitudinally apart from said first pair. Each leg, as shown in FIG. 3 for representative legs 24, 26, has a first web portion extending perpendicularly to, and rearwardly of the block 18, and a second flange portion extending generally parallel to, and at a slight spacing from, the rear of the block 18. The L-shaped legs together form a slide channel 32. As also shown in FIG. 3, the flange portions of each pair of legs extend toward, but terminate short of, each other.

Figure 4:
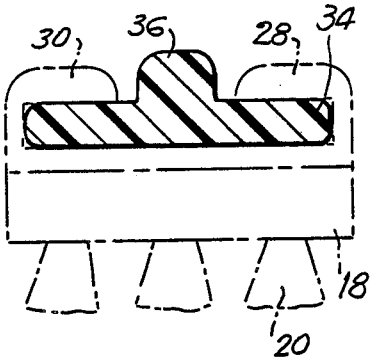
FIG. 4 is an enlarged sectional view taken along line 4—4 of FIG. 1.

The handle 12, as shown in FIG. 4, has a generally T-shaped cross-section having a slide track portion 34 which is accommodated in the slide channel 32, and a guide portion 36 which extends longitudinally along, and rearwardly of, the slide track portion 34 between the pairs of spaced-apart flange portions of the legs.

Figure 6:
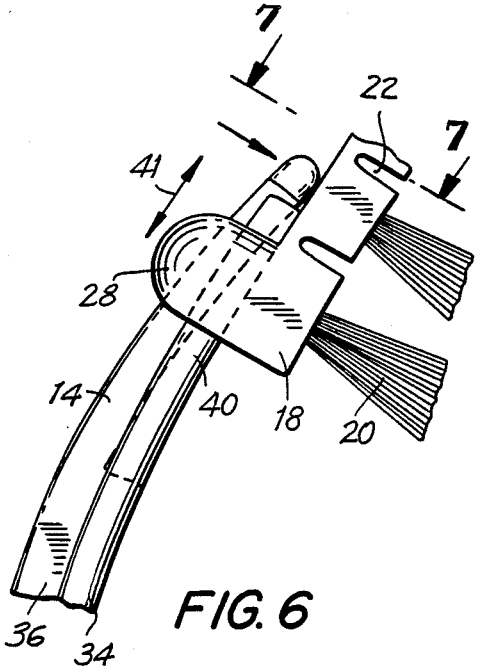
FIG. 6 is a greatly enlarged side view of an upper part of the toothbrush of FIG. 1 during removal of the brush block from the handle.
Figure 5:
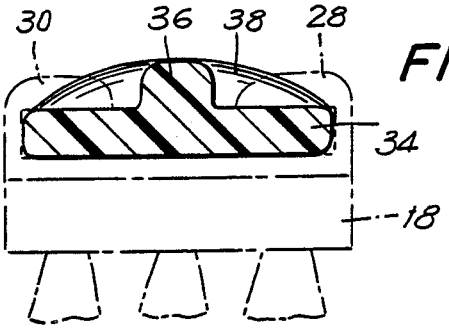
FIG. 5 is an enlarged sectional view taken along line 5—5 of FIG. 1.
Figure 7:
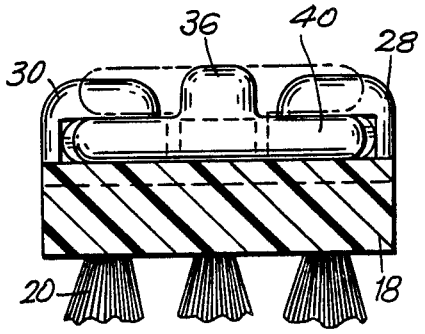
FIG. 7 is an enlarged sectional view taken along line 7—7 of FIG. 1.

As best shown in FIGS. 1 and 5, a stationary abutment 38 is integral with the handle at curved end region 16. Abutment 38 extends across the path of movement of block 18 and prevents the same from being moved past end region 16 and removed from the handle at that location. As best shown in FIGS. 2 and 6, a displaceable abutment 40 is integral with the handle 12 at curved end region 14, and is displaceable between an abutting position (see FIG. 3) in which the displaceable abutment is situated across the path of movement of the block so as to prevent the same from being moved past curved end region 14 and removed from the handle at that location, and a release position (see FIG. 6) in which the displaceable abutment is situated remote from, and out of, the path of movement of the block, thereby permitting the block to either be slid off or slid onto the handle in the directions of double-headed arrow 41. The displaceable abutment 40 is generally T-shaped in plan view, and has a resiliently-yieldable stem 42 which is preferably a continuation of guide portion 36, and a cross-bar 44 which abuts against the flanges of legs 24, 26 in the aforementioned abutting position.

Prior to use, a user depresses the displaceable abutment 40 from its normally assumed abutting position, and generally into the curvature of the handle at curved end region 14, so that the block 18 can be slid past the displaced abutment 40 in its release position onto the curved end region 14 of the handle 12. Then, the abutment 40 is released so that it will return, due to its inherent resilience, to its abuttng position. The block 18 can now be slid lengthwise of the handle. At the curved end region 14, it is the curved end region 14 itself which bends the more flexible block 18 to assume a concave contour and, at the same time, the bristles 20 are forced to assume a concave configuration. At the curved end region 16, it is the curved end region 16 itself which bends the more flexible block 18 to assume a convex contour and, at the same time, the bristles 20 are forced to assume a convex configuration. The user may use the convexly- or concavely-curved bristles at his or her option merely by sliding the block to either end region of the handle.

As also shown in FIG. 1, during transfer of the block 18 between curved end regions 14, 16, the block is not bent, but, instead, has a parallelepiped shape, and the bristles 20 supported by the block have their outer ends arranged in a generally planar configuration.

The legs 24, 26, 28, 30 snugly frictionally engage the slide track portion 34 of the handle, and prevent the block from being accidentally moved toward the center of the handle. The abutments 38, 40 prevent the block from being accidentally removed from the handle. Should the bristles on a mounted block 18 be worn, or should it be desired to exchange one bristle block for another in the case of a shared use, then the displaceable abutment 40 is moved once again, and deformed into the general curvature of curved end region 14 so that the block 18 can be moved past the displaced abutment 40 in the release position.

Figure 8:
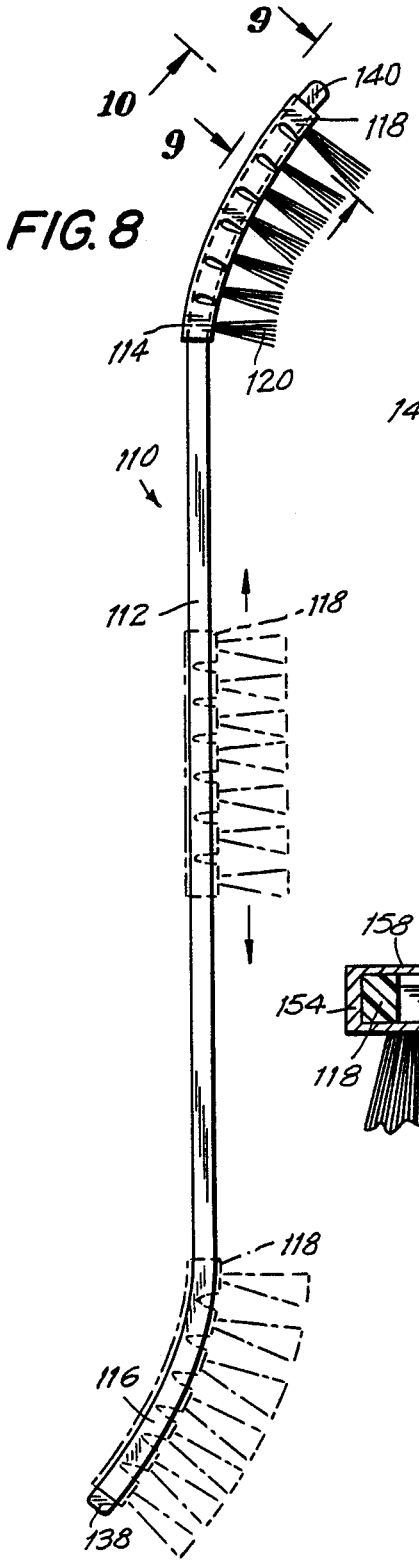
FIG. 8 is a side view of a convertible toothbrush according to another embodiment of this invention.
Figure 9:
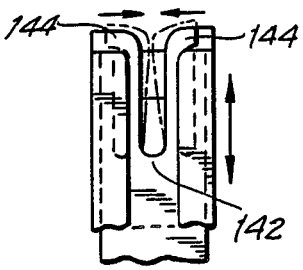
FIG. 9 is a rear plan view taken along line 9—9 of FIG. 8.
Figure 10:
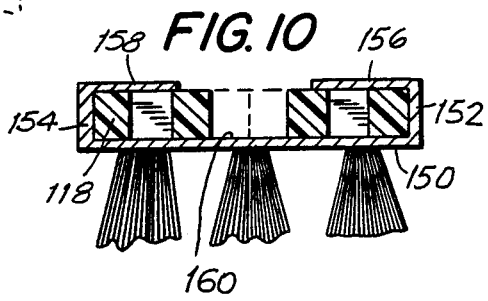
FIG. 10 is an enlarged sectional view taken along line 10—10 of FIG. 8.

In a second embodiment of this invention, as shown in FIGS. 8–10, like parts have been identified with the same reference numerals as employed in the first embodiment, but with the numeral one-hundred added to the previously used numerals.

Thus, toothbrush 110 has handle 112 provided with oppositely curved end regions 114, 116. A slidable brush block 118 having bristles 120 embedded therein is mounted for longitudinal movement lengthwise of handle 112. Stationary abutment 138 and displaceable abutment 140 are provided at curved end regions 116, 114, respectively. In contrast to tne first embodiment, rather than providing opposing pairs of legs on the brush block for enabling the same to be slid lengthwise along a slide track portion of the handle, this second embodiment proposes that the handle 112 itself be provided with wall portions defining a channel. To that end, as best shown in FIG. 10, handle 112 has a base track portion 150, side web portions 152, 154 extending perpendicularly and rearwardly of base portion 150, and flange portions 156, 158 extending generally parallel to, but at a slight spacing from, base portion 150. Flange portions 156, 158 extend toward, but terminate short of, each other. The base, web and flange portions of handle 112 form a channel 160 along which the block 118 is slidably engaged for longitudinal movement between curved end regions 114, 116.

Also, in contrast to the previous embodiment, the displaceable abutment is not fashioned as a cantilevered T-shaped member, but, instead, as best shown in FIG. 9, has a generally U-shape in plan view having a bifurcated stem portion 142 and a pair of outwardly extending abutting portions 144, 144. Rather than displacing displaceable abutment in a radial direction, as considered in the direction of the radius of curvature of the first embodiment, the abutting portions 144, 144 in FIG. 9 are squeezable toward each other to assume a release position and, when released, are displaced by their own inherent resilience back to an abutting position wherein the abutting portions are situated in the path of movement of the block 118.

Figure 11:
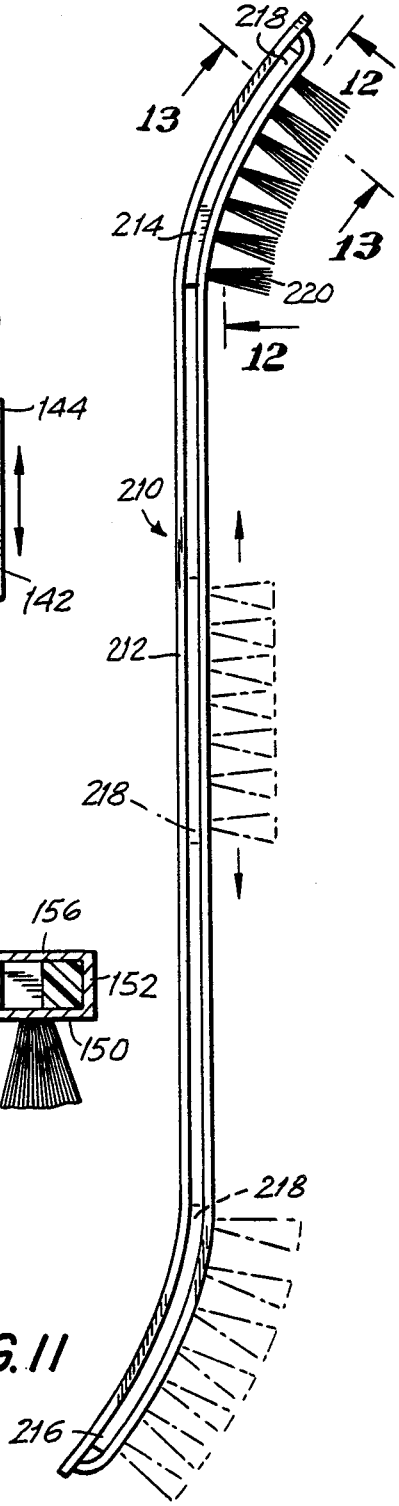
FIG. 11 is a side view of a convertible toothbrush according to still another embodiment of this invention.

In a third embodiment of this invention, as shown in FIGS. 11–13, like parts have been identified with the same reference numerals as employed in the first embodiment, but with the numeral two-hundred added to the previously used numerals.

Thus, toothbrush 210 has a handle 212 provided with oppositely curved end regions 214, 216 of shape-retaining material. A brush block 218 having bristles 220 supported thereon is slidable lengthwise of handle 212 between curved end regions 214, 216 in a similar manner to that described previously so that the bristles assume either a concave or convex configuration.

In contrast to the previous two embodiments, rather than providing a brush block with legs bounding a channel-shaped slide track, or rather than forming the handle 112 with wall portions defining a channel-shaped slide track, a pair of wires 262, 264, preferably of circular cross-section and constituted of metal material, are arranged so as to be situated at a slight distance in front of the handle 212 in order to define a slide track therebetween in which the block 218 is slidably engaged. As best shown in FIG. 13, the block 218 slidably engages the handle 212 at one of its major surfaces, and slidably engages the wires 262, 264 at its opposite major surface.

The wires 262, 264 extend along virtually the entire length of the handle 212, and are slightly displaceable apart from each other in a transverse direction to the dashed-line positions shown in FIG. 13 and identified reference numerals 262', 264'. In the outwardly-displaced position of the wires, the brush block 218 may conveniently be inserted into sliding engagement with the handle 212, after which, upon release of the wires 262, 264, the wires will return, due to their inherent resilience, to their original position overlying the block 218.

In a fourth embodiment of this invention, as shown in FIGS. 14–17, like parts have been identified with the same reference numerals as employed in the first embodiment, but with the numeral three-hundred added to the previously used numerals.

Thus, toothbrush 310 includes a handle 312 provided with oppositely curved end regions 314, 316 responsible for bending brush block 318 to assume either the concave or convex bristle configuration shown in FIG. 14. Stationary abutments 338, 340 are provided at opposite ends of the handle 312. The handle 312 has a T-shaped cross-section having a slide track portion 334 and a guide portion 336. The block 318 has three pairs of legs, 324, 326 at one end region, 328, 330 at its opposite end region, and 366, 368 at its central region. All of the legs have an L-shape, and together bound a slide channel 332 in and along which slide track portion 334 is slidably engaged. As before, guide portion 336 is situated between opposing spaced-apart flange portions of each pair of legs on the block 318.

In addition to the third pair of legs 366, 368 provided on block 318, and in addition to the lack of any displaceable abutment at one end of the handle, this fourth embodiment is further modified from the previous embodiments by the provision of wall means in a central portion of the handle 312, said wall means bounding an opening 370 through which the block 318 is inserted to facilitate mounting of the block onto the handle 312. As best shown in FIG. 17, there is no slide track in the region of central opening 370, so that the block 318 may be inserted in a direction generally perpendicular to the central section of handle 312 and, thereupon, the block 18 may be slid, as desired, to either end region 314 or end region 316. In either case, the legs will engage slide track portion 334 once the block 318 is moved past the central opening 370.

In a variant of the fourth embodiment, rather than providing an opening 370 or interruption in the slide track portion 334, the latter may be continuous, in which case, the brush block 318 is snapped onto the slide track portion 334 by affirmatively urging the brush block 318 onto the slide track portion. To facilitate such snapping engagement, the block legs or the slide track 334 are made resiliently yieldable so that one will be displaced out of the way of the other during such affirmative urging.

The aforementioned exemplary embodiments show that it does not matter where the brush block is mounted on the handle. Thus, the block may be mounted at one end region or at a central region, or, for that matter, anywhere along the length of the handle. It also does not matter whether the block or the handle forms a channel-shaped track. The essential aspect of this invention is that the block be more flexible than the handle so that, once the block is moved to either curved end region of the handle, it is the curved end region itself which bends the block to the desired configuration for the bristles so that the user may conveniently change the bristle configuration.

Figure 18:
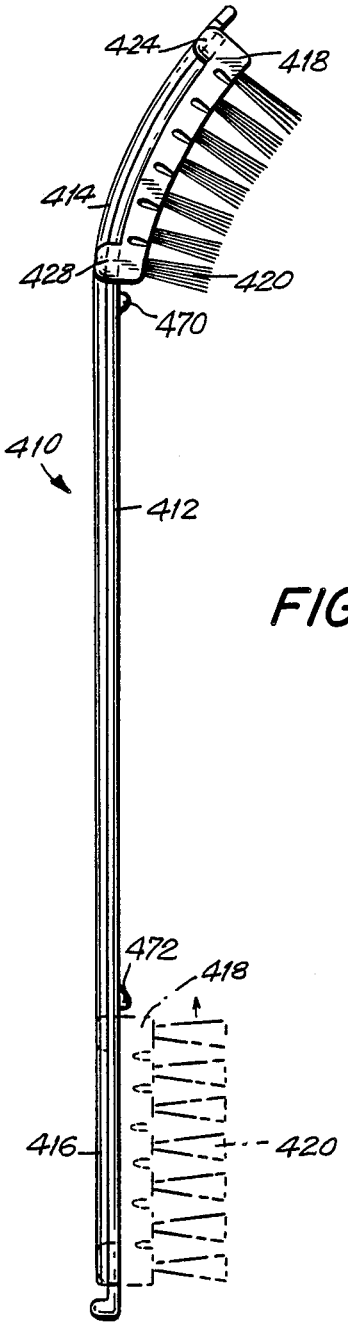
FIG. 18 is a side view of a convertible toothbrush according to an additional embodiment of this invention.

Finally, in a fifth embodiment of this invention, as shown in FIG. 18, like parts have been identified with the same reference numerals as employed in the first embodiment, but with the numeral four-hundred added to the previously used numerals.

Thus, toothbrush 410 includes a handle 412 provided with a curved end region 414 and a straight end region 416. A flexible brush block 418 for supporting tufts of bristles 420 is formed with trahsverse slits 422 to enhance the flexibility of the block. Block 418 is provided with legs, e.g. 424, 428, for mounting the block on the handle for longitudinal movement between opposite end regions of the handle. As before, the curved end region 414 bends the flexible block and the bristles supported thereon into a correspondingly curved configuration. Of course, the curved end region 414 may have either a convex or concave contour, as desired.

The new FIG. 18 embodiment departs from the previous embodiments in that the straight end region 416 does not affirmatively bend the flexible block into a curved configuration, but, instead, enables the flexible block and the bristles supported thereon to assume a generally straight configuration. Thus, the toothbrush 410 is convertible between a curved and a straight configuration.

Rather than relying upon frictional engagement and a snug fit between the brush block 418 and the handle 412 in order to maintain the brush block in either one of its positions at curved end region 414 or straight end region 416, the handle 412 is further provided with a raised bead 470 and/or a resilient stopper 472, both of which act to affirmatively resist the block from moving away from the curved or straight end regions, respectively, by serving as a barrier in the path of movement of the brush block away from either end region.

It will be understood that each of the elements described above, or two or more together, also may find a useful application in other types of constructions differing from the types described above While the invention has been illustrated and described as embodied in a convertible toothbrush, it is not intended to be limited to the details shown, since various modifications and structural changes may be made without departing in any way from the sprit of the present invention.

Without further analysis, theforegoing will so fully reveal the gist of the present nivention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A convertible toothbrush, comprising:

an elongated handle of shape-retaining material and having a curved portion;

a flexible brush block for supporting bristles; and means mounting the flexible brush block on the handle for longitudinal movement along the elongation of the handle, said curved portion bending the flexible block and the bristles supported thereon into a correspondingly curved configuration when the flexible block is moved onto the curved portion.

2. The toothbrush as recited in claim 1, wherein the handle has a generally S-shaped contour, and wherein the curved portion is located at one end region of the handle and has a predetermined curvature, and wherein the handle has another curved portion located at an opposite end region of the handle and having an opposite curvature to said predetermined curvature, and wherein the mounting means mounts the flexible block for longitudinal movement between said one handle end region in which the curved portion thereat bends the flexible block and the bristles supported thereon into a generally concaveconfiguration, and said opposite handle end region in which the other curved portion thereat bends the flexible block and the bristles supported thereon into a generally convex configuration.

3. The toothbrush as recited in claim 1, wherein the curved portion is located at one and region of the handle, and wherein the handle has a straight portion located at an opposite end region of the handle, and wherein the mounting means mounts the flexible block for longitudinal movement between said one handle end region in which the curved portion thereat bends the flexible block and the bristles supported thereon into a generally curved configuration, and said opposite handle end region in which the other straight portion thereat enables the flexible block and the bristles supported thereon to assume a generally straight configuration.

4. The toothbrush as recited in claim 1, wherein the handle has opposite end regions, and wherein the mounting means includes means for preventing the flexible block from moving past either end region off the handle.

5. The toothbrush as recited in claim 4, wherein the preventing means includes a stationary abutment in the path of movement of the block at one of the end regions, and a displaceable abutment at the other of the end regions and displaceable between an abutting position in which the displaceable abutment is situated in the path of movement of the block at the other end region, and a release position in which the displaceable abutment is situated remote from the path of movement of the block.

6. The toothbrush as recited in claim 5, wherein the displaceable abutment is integral with the other end region and is resiliently yieldable.

7. The toothbrush as recited in claim 1, wherein the block has slits extending transversely to the path of movement thereof to enhance the flexibility of the block.

8. The toothbrush as recited in claim 1, wherein the handle has a slide track, and wherein the mounting means includes legs on the block, said legs forming a slide channel along which the slide track is slidably engaged.

9. The toothbrush as recited in claim 1, wherein the handle has a channel-shaped slide track along which the block is slidably engaged.

10. The toothbrush as recited in claim 1, wherein the mounting means includes a pair of guide wires spaced from and extending along the handle to form a channel along which the block is slidably engaged.

11. The toothbrush as recited in claim 1, wherein the mounting means includes a longitudinal guide extending along the handle for guiding the block during said movement.

12. The toothbrush as recited in claim 1, wherein the mounting means includes an opening in the handle and through which the block is inserted to facilitate mounting of the block on the handle.

13. The toothbrush as recited in claim 5, wherein the block is removably and interchangeably mounted on the handle in the release position of the displaceable abutment.

14. The toothbrush as recited in claim 1, wherein the mounting means includes means for snappingly engaging the block on the handle with snap action.

15. The toothbrush as recited in claim 1, wherein the mounting means includes means for resisting the flexible block from moving away from the curved portion.

16. The toothbrush as recited in claim 15, wherein the resisting means includes means for frictionally engaging the block when the same is located on the curved portion.

17. A convertible toothbrush, comprising:

a generally S-shaped handle of shape-retaining material and having curved end portions of opposite curvature;

a flexible, bendable brush block for supporting bristles; and means mounting the flexible block on the handle for movement between one of the curved end portions in which the one curved end portion bends the flexible block and the bristles supported thereon into a generally concave configuration, and another of the curved end portions in which the other curved end portion bends the flexible block and the bristles supported thereon into a generally convex configuration.

* * * * *